US007591435B1

(12) United States Patent
Downey et al.

(10) Patent No.: US 7,591,435 B1
(45) Date of Patent: Sep. 22, 2009

(54) SAFETY AIR GUNS

(75) Inventors: William T. Downey, Boston, MA (US); Mark W. Yorns, Longmeadow, MA (US)

(73) Assignee: Guardair Corporation, Chicopee, MA (US)

( * ) Notice: Subject to any disclaimer, the term of this patent is extended or adjusted under 35 U.S.C. 154(b) by 351 days.

(21) Appl. No.: 11/669,125

(22) Filed: Jan. 30, 2007

Related U.S. Application Data

(63) Continuation-in-part of application No. 29/249,811, filed on Oct. 23, 2006, now Pat. No. Des. 561,874.

(51) Int. Cl.
*B05B 17/00* (2006.01)

(52) U.S. Cl. ..... 239/1; 239/290; 239/525; 239/530; 239/583; 239/586; 239/DIG. 21; 239/DIG. 22

(58) Field of Classification Search ..... 239/290, 239/291, 525, 530, 569, 583, 586, DIG. 21, 239/DIG. 22, 1, 600; D23/226
See application file for complete search history.

(56) References Cited

U.S. PATENT DOCUMENTS

| | | | | | |
|---|---|---|---|---|---|
| 2,645,528 | A | * | 7/1953 | Thorsen | 239/430 |
| D179,859 | S | | 3/1957 | Mortimore | |
| D181,979 | S | | 1/1958 | Hungate | |
| D228,235 | S | | 8/1973 | Otto | |
| 3,774,847 | A | * | 11/1973 | Malec | 239/586 |
| 3,980,238 | A | * | 9/1976 | Adiletta | 239/DIG. 22 |
| 4,091,999 | A | * | 5/1978 | Voos | 239/586 |
| 4,919,334 | A | * | 4/1990 | Hartmann et al. | 239/600 |
| 5,464,155 | A | | 11/1995 | Schutter | |
| 5,634,840 | A | * | 6/1997 | Watkins | 446/475 |

* cited by examiner

*Primary Examiner*—Steven J Ganey
(74) *Attorney, Agent, or Firm*—Scott E. Kamholz; Foley Hoag LLP

(57) ABSTRACT

A safety air gun may include a body, a valve, and a valve-operating lever. The body may have a shape that curves from an inlet end to an outlet end, thereby defining a convex side and a concave side. The body may define a bore that extends between the inlet end and the outlet end. The valve may so intersect the bore as to regulate flow through the bore. The valve-operating lever may be positioned on the convex side of the body and operably coupled to the valve.

23 Claims, 12 Drawing Sheets

SAFETY AIR GUNS

CROSS-REFERENCE TO RELATED APPLICATION

This application is a continuation-in-part of U.S. application Ser. No. 29/249,811, filed Oct. 23, 2006, which is hereby incorporated herein by reference.

DETAILED DESCRIPTION

Figure 1:
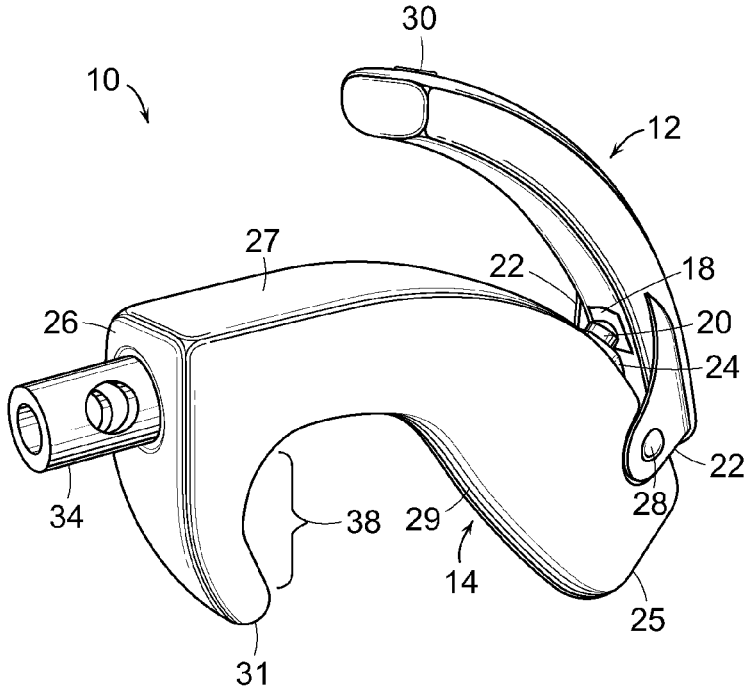
FIG. 1 shows a perspective view of an embodiment of a safety air gun.
Figure 2:
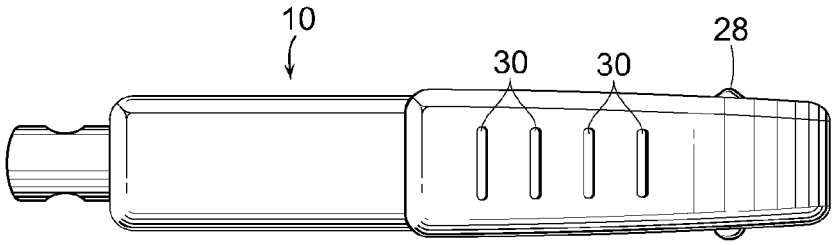
FIGS. 2-3 show top and bottom plan views, respectively, of the safety air gun embodiment of FIG. 1.
Figure 3:
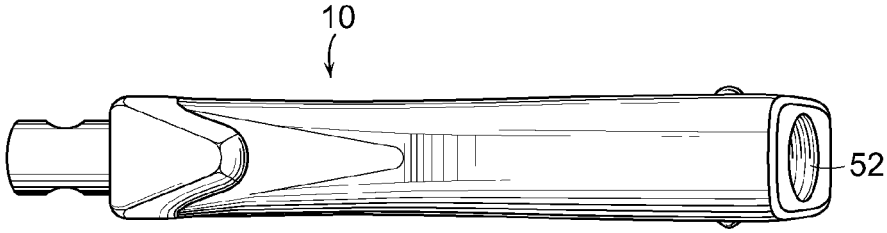

Safety air guns ("airguns") are used to deliver a stream of pressurized air through a nozzle to a target. Exemplary uses include clearing debris, removing dust, and other cleaning tasks. Airguns typically include a handle and a nozzle connected to the handle. The handle receives a pressurized air supply and directs it to the nozzle under the control of a user-operated valve.

FIGS. 1-6 show various views of an embodiment of a safety air gun 10. The safety air gun includes a body 14 having a shape that curves from an inlet end 25 to an outlet end 26, thereby defining a convex side 27 and a concave side 29. The body 14 may define a bore extending between the inlet end 25 and the outlet end 26. A valve-operating lever 12 may be positioned on the convex side 27 of the body 14 and operably coupled to a valve (not shown) that regulates flow through the bore. A valve chamber assembly having valve body 24 and valve stem 20 may be positioned on the convex side of the body 14 such that the valve stem 20 makes contact with lever 12, such as at strike plate 18, upon actuation.

The convex side 27 and/or the concave side 29 of body 14 may be formed with straight and/or curved surfaces. The body 14 may bulge in a portion adjacent to the inlet end 25. The body may also have a protuberance 31 extending from the concave side near the outlet end 26, thereby defining a hook region 38 with part of concave side 29. The hook region 38 may be of any shape that provides an adequate holding support or resting position for an index finger while the device is in use. For example, the protuberance 31 may have a relatively large width proximate the body, to provide a large contact area for the index finger, and may taper distally to provide a small tip to facilitate hanging up the gun by the tip in a small hole.

A pivot pin 28 may extend between the guards and through a hole (element 53 in FIG. 11) in the body, thereby allowing lever 12 to pivot about an axis defined by pivot pin 28 and relative to body 14. The lever may include grip features, such as ridges 30, to help improve a user's grip on the lever. The lever 12 may be curved along its longitudinal length between the attachment position and the more distant of the two ends. The lever curvature may be constant (i.e., the lever forms a sector of a circle), or it may follow other curves, such as a sector of a parabola, ellipse, oval, involute, or a curvature of increasing radius from the attachment position to the more distant of the two ends; the lever may have regions with curvatures differing from one another, may have regions of varying curvature, and/or may have regions with no curvature.

Space between the body and the lever may be covered with pinch guards 22 to help prevent pinching a user's skin between the body and lever when the lever is actuated. Pinch guards 22 may also connect the lever to the body, as shown in the drawings.

Figure 4:
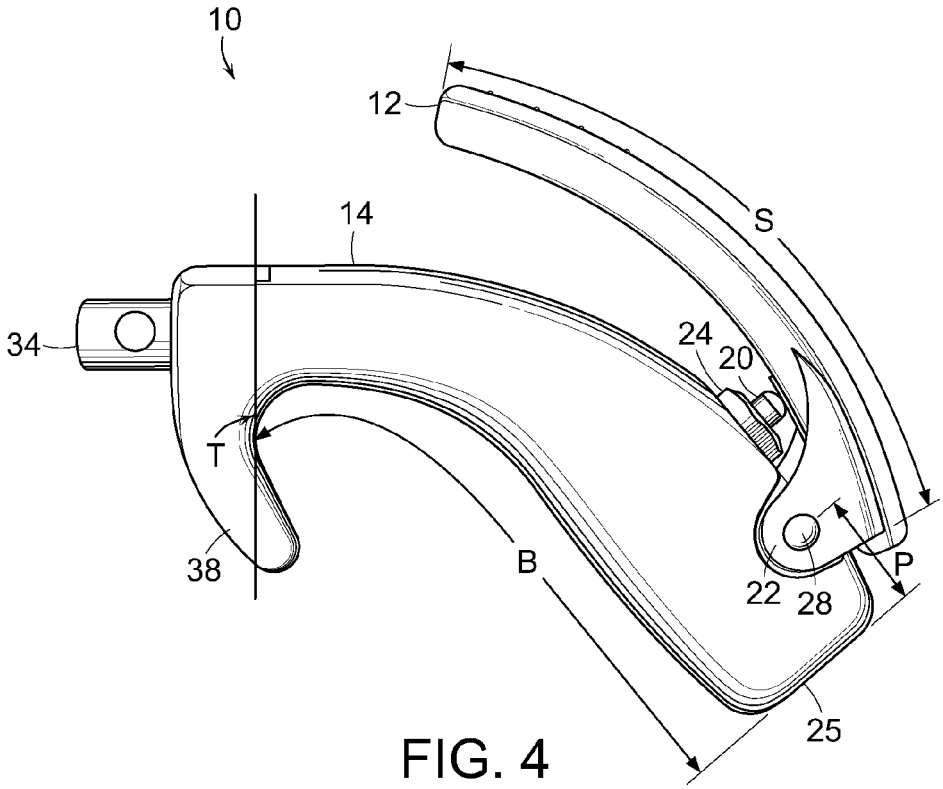
FIGS. 4-6 show side, front, and back elevation views, respectively, of the safety air gun embodiment depicted in FIG. 1.
Figure 5:
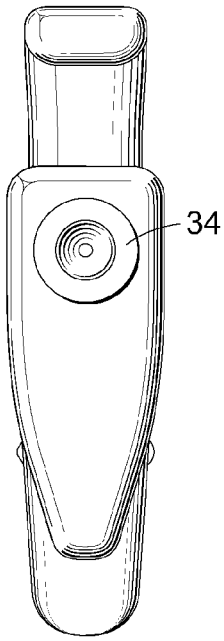
Figure 6:
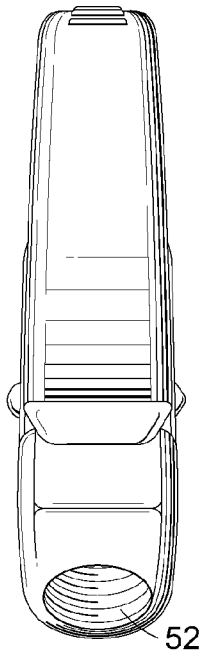

FIG. 4 provides a side view of the safety air gun embodiment. Dimension S refers to the longitudinal curved length of the lever measured from a distal end to a proximal end of the lever 12. In some embodiments, dimension S may have a length of at least 4⅛ inches. Such a length may make it possible for a user to grasp and/or press the lever with the entire length of the thumb and thenar eminence (the body of muscle at the base of the thumb), effectively increasing the lever's mechanical advantage and/or reducing pressure on the user's tissue by increasing the contact area. Point T is a point at which a perpendicular dropped from the convex surface of the body 14 is tangent to a curve that defines in part the hook region 38. Dimension B defines a curved length of the concave side extending from point T to outlet end 25 and in some embodiments may be at least 4 inches. In some embodiments, length S may be at least as long as the body length B. Dimension P is measured from the center of the pivot pin 28 to the outlet end 25 and may be in the range of 0 to about 1 inch, such as ¾ inch or less. The pivot may alternatively be positioned at or within similar distances from the outlet end. Positioning the pivot near one of the ends, in combination with providing dimensions S and B as described, helps to ensure that the safety air gun fits across a user's palm without terminating in the center of the palm. This positioning helps prevent the gun from exerting pressure on the nerves, sheaths, and other structures in the user's palm that are vulnerable to repetitive-stress injury. It also allows tubing attached to the inlet end (not shown) to drop away downward, thereby minimizing bending moments on the user. The pivot may be so positioned as to be roughly or exactly coaxial with the axis of rotation of the thumb when it moves from an open position into an open-fisted position.

Figure 7:
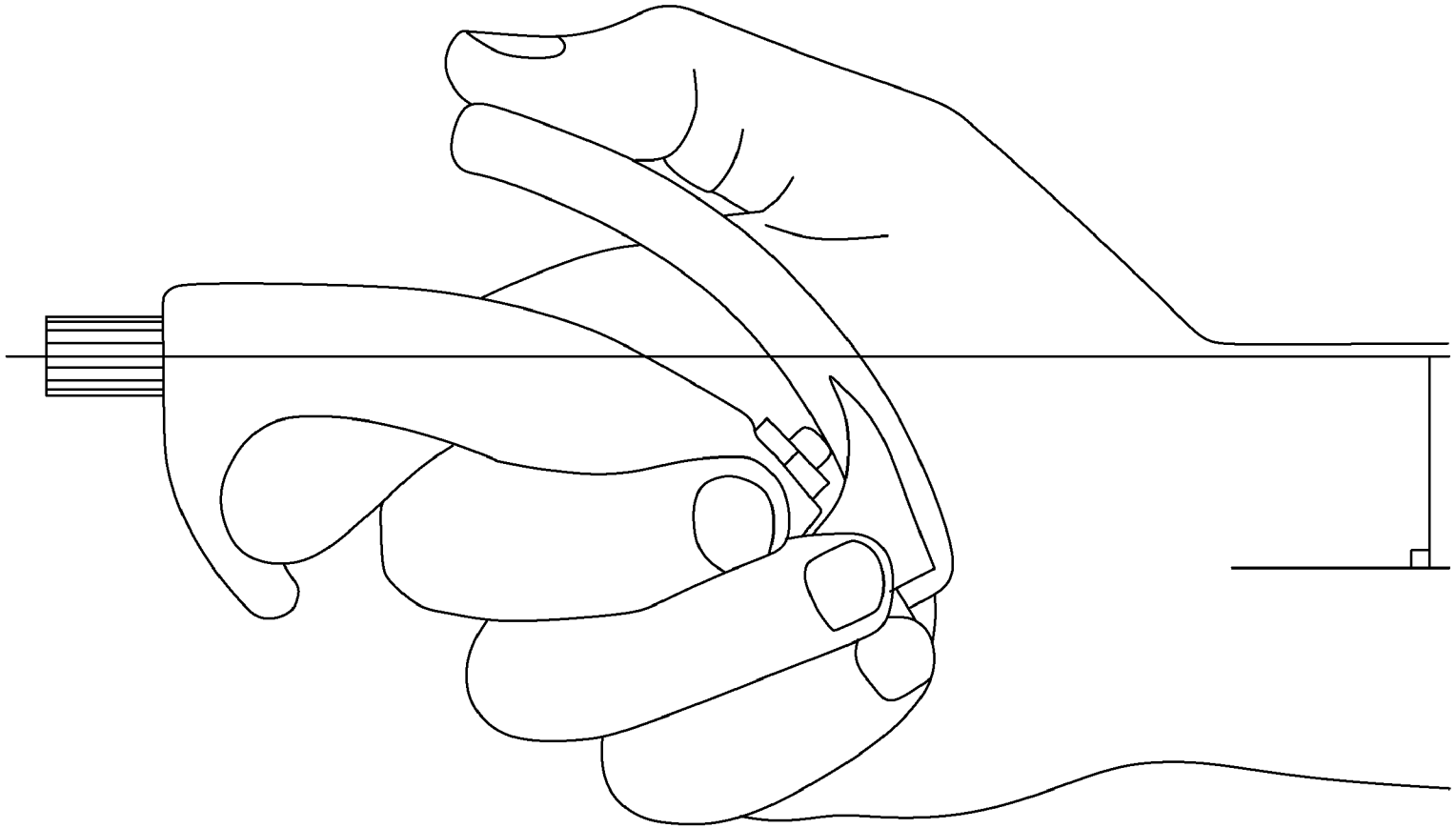
FIG. 7 depicts a safety air gun embodiment held in a user's hand.

Further combining these dimensions with an angle or curvature in the body helps to align the nozzle direction with the user's forearm axis, thereby permitting use of the device with the wrist in a neutral position. FIG. 7 depicts the safety air gun embodiment held in a user's hand. The gun is comfortably nestled in the user's palm between the third, fourth, and fifth digits and the thenar eminence. The index finger is positioned in the hook region to anchor and stabilize the user's grip. The thumb and the thenar eminence rest against the lever. The dimensions of the gun are such that when the user's wrist is in a neutral position relative to the forearm (i.e., neither adducted nor abducted), the nozzle of the gun is aligned with the user's forearm. Moreover, the slight bulge in the body near the inlet end (hidden by the user's fingers in FIG. 7) encourages the user to grip the gun body above the bulge instinctively, thereby helping to ensure that the inlet end is not positioned in the center of palm but is rather offset slightly. The bulge may also help to prevent reactive forces from wrenching the gun out of the user's hand during operation. The bulge, in combination with the other disclosed features, may contribute to encouraging the user to assume an ergonomic grip on the device. Indeed, these features may contribute synergistically to encouraging an ergonomic grip.

Figure 8:
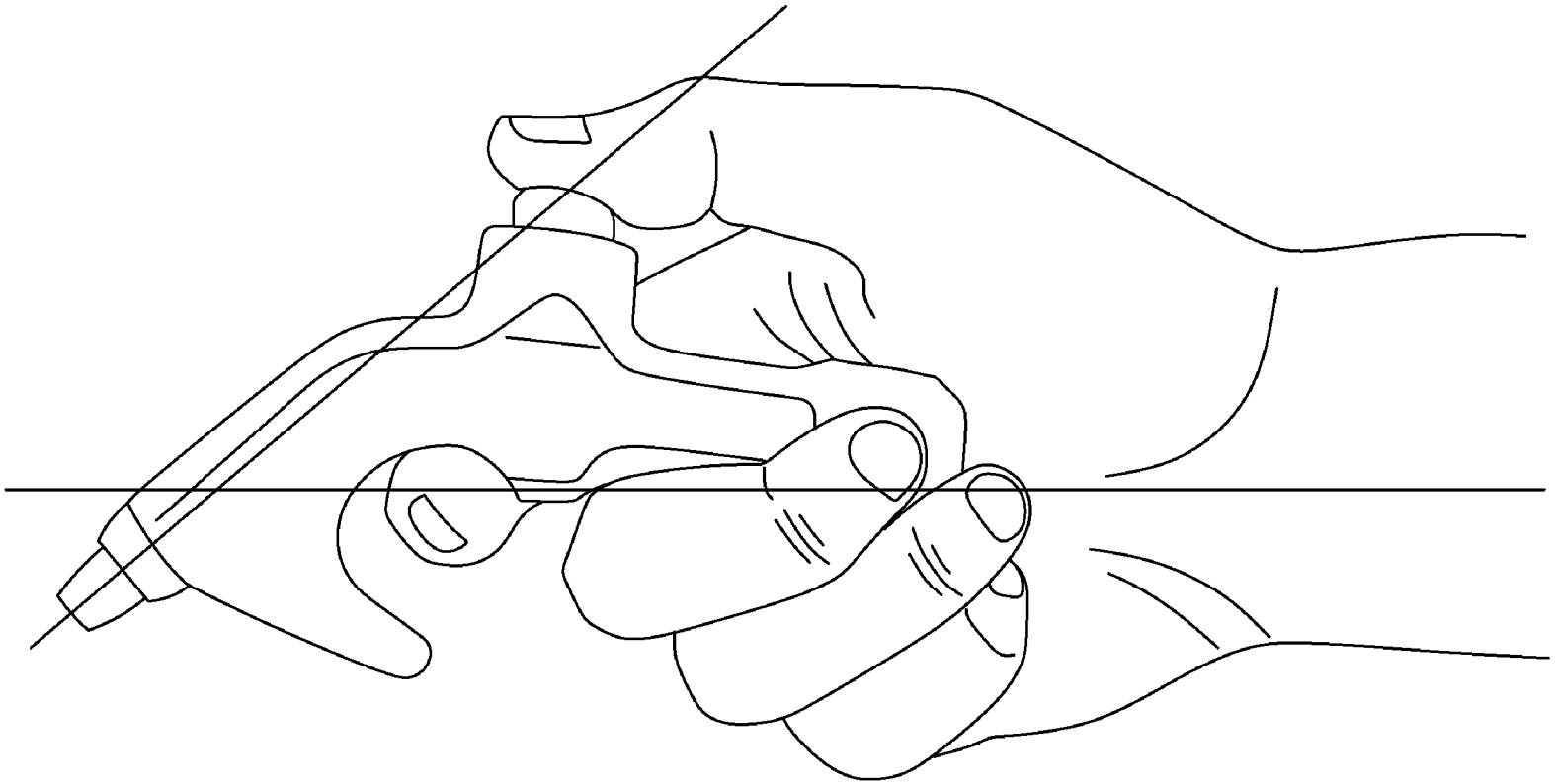
FIG. 8 Prior Art
FIGS. 8-9 depict prior-art air guns held in a user's hand.
Figure 9:
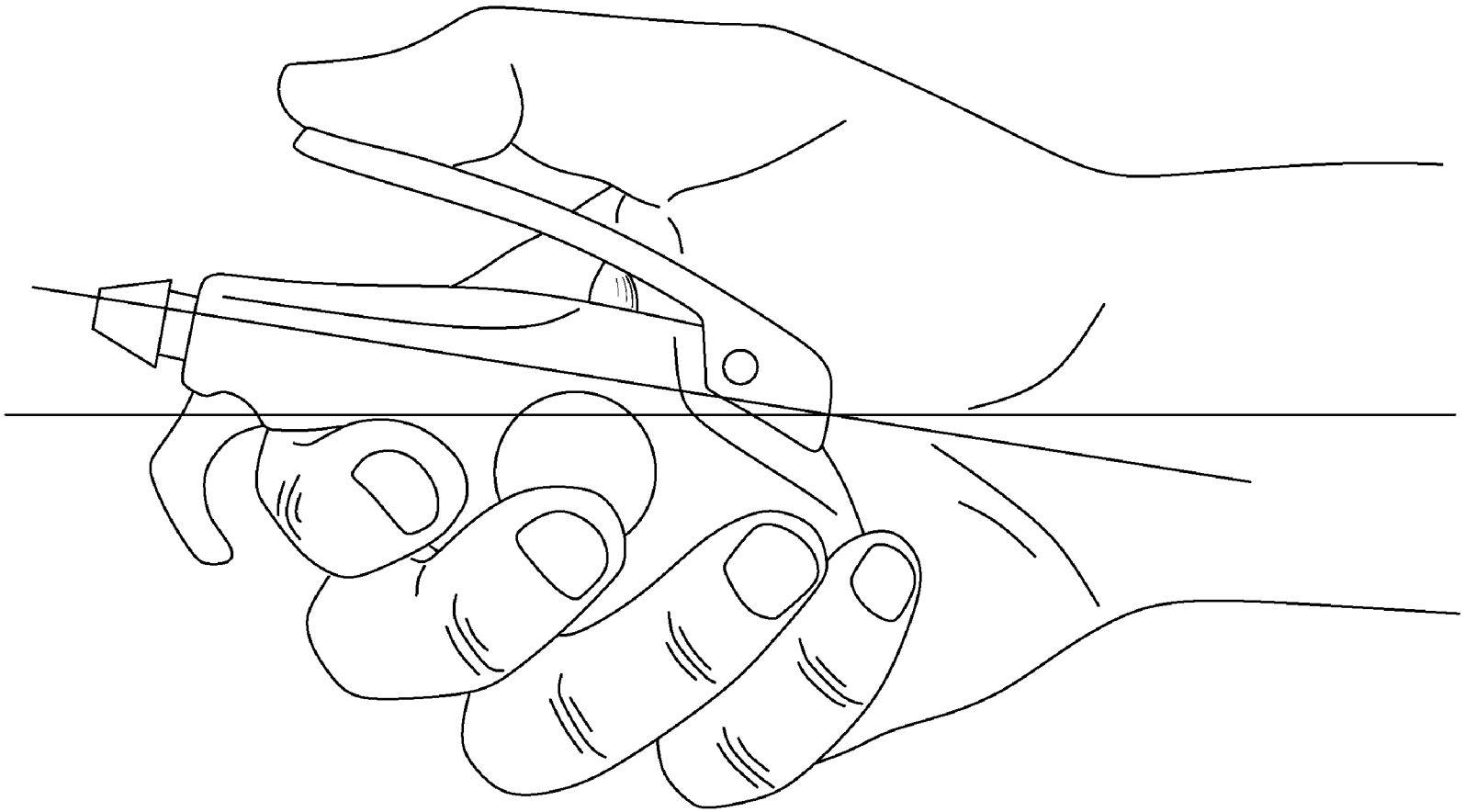
FIG. 9 Prior Art

Prior art guns do not encourage an ergonomic grip and do not achieve the relationships described above. See, for example, FIGS. 8-9. The gun shown in FIG. 8 is actuated by pressing a push-button with the thumb. This requires holding the gun so that its inlet end lies in the middle of the user's palm. In this position, the gun has a tendency to press against nerves, sheaths, and other structures in the palm and thereby creates discomfort during prolonged use and/or risk of repetitive-stress injury. Also, its nozzle direction is not aligned with the user's forearm, thereby requiring the user to abduct the hand at the wrist to achieve alignment—a position that is uncomfortable for extended periods. The body of the gun shown in FIG. 9 does not curve from the inlet end to the outlet end or otherwise angle the inlet end relative to the outlet end. Consequently, when the gun is held in the most comfortable grip with the wrist in a neutral position, the nozzle axis is not aligned with the forearm axis. In this case, the user must adduct the hand at the wrist to compensate—also a position that is uncomfortable for extended periods. Users may try to compensate for these uncomfortable positions and reduce the amount of adduction/abduction required to make the nozzle horizontal by instead pronating the forearm. Pronation, however, creates new disadvantages: in the pronated position, the user cannot use the biceps muscle significantly to support the forearm, and tubing connected to the inlet end points upward and/or outward, creating additional bending moments on the user and increasing the perceived weight of the device.

Figure 10:
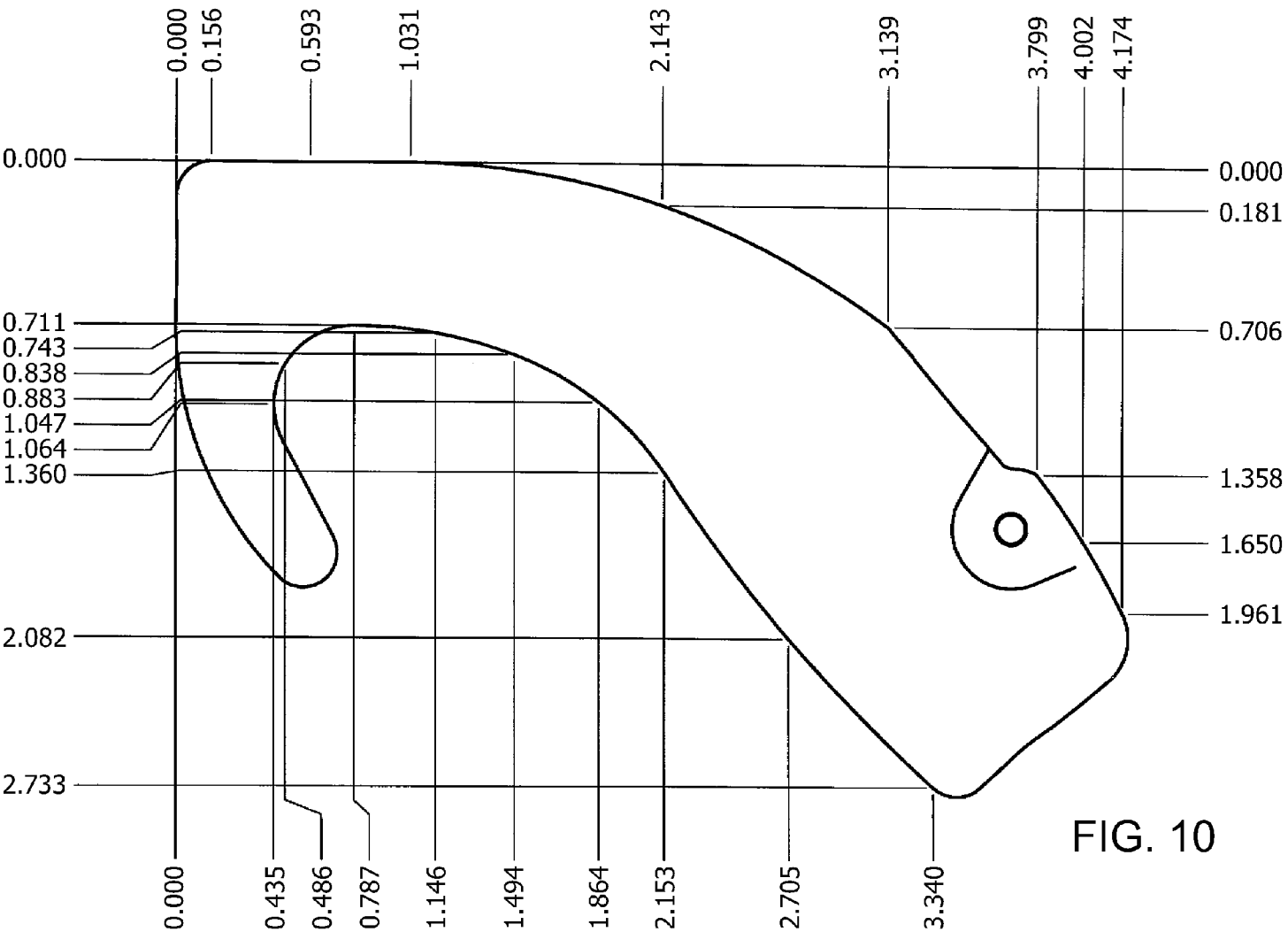
FIG. 10 provides relative coordinate measurements for the contour of a safety air gun body embodiment.

FIG. 10 depicts an outline of a safety air gun body shape and provides relative coordinates (in inches) for points along the convex and concave sides. In various other embodiments, a body's convex and/or concave sides may follow points within ⅛ inch, 1/10 inch, and/or 1/16 inch of the relative coordinates indicated.

Figure 11:
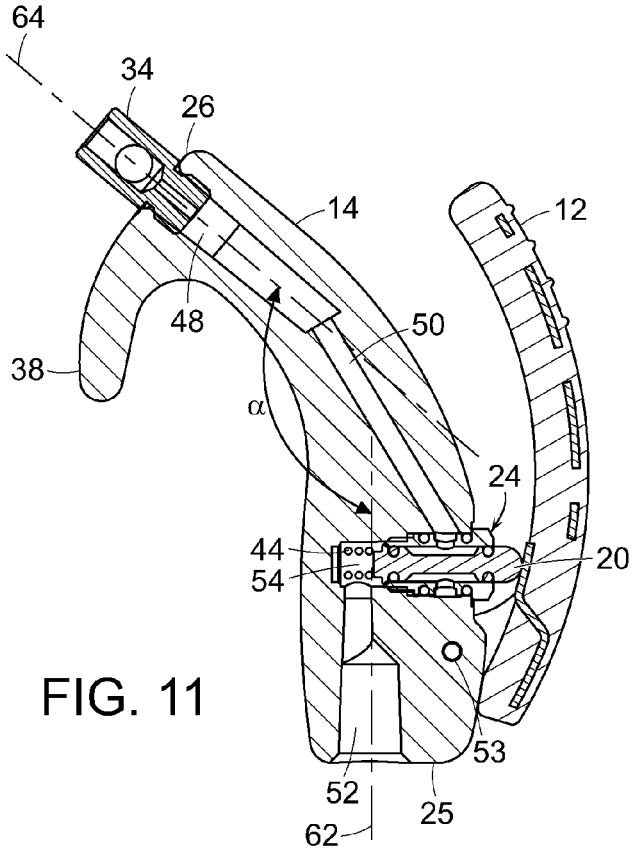
FIG. 11 depicts a longitudinal cross-section of an embodiment of a safety air gun.

FIG. 11 depicts a longitudinal cross-sectional view of a safety air gun embodiment. The body 14 defines a bore extending from the inlet end 25 to the outlet end 26. The bore may be formed from a series of segments, such as linear segments. In the depicted embodiment, the bore has four linear segments. An inlet bore segment 52 may extend from an opening at the inlet end 25. A valve bore segment 54 may open to the convex side of the body 14. The valve bore segment 54 may communicate with the inlet bore segment 52. An intermediate bore segment 50 may communicate with the valve bore segment 54, and an outlet bore segment 48 may communicate with the intermediate bore segment 50 and open at the outlet end 26. The intermediate bore segment 50 may be oriented at an angle such that it can be accessed from outside the body through the valve bore segment opening on the convex side without having to drill or otherwise create any other holes in the body. Such an arrangement facilitates, for example, creating the intermediate bore segment in a single step such as by casting, drilling, or otherwise, as described below.

All or portions of the inlet bore segment 52, the outlet bore segment 48, and/or the valve bore segment 54 may be threaded to facilitate attachment of pieces to those bores. For example, a hose can be attached to the inlet end by screwing it into the inlet bore segment; nozzle 34 can be attached to the outlet end by screwing it into the outlet bore segment (although it may be attached in other ways, such as press-fitting, or it may be integrally formed with the body); and/or valve body 24 may be attached to the body in the valve bore segment with a similar variety of techniques.

The valve body 24 and valve stem 20 may be placed in the valve bore segment 54 to regulate flow through the bore. A spring 44 may be so positioned relative to the valve stem as to bias the valve to a closed position.

As discussed above, the body may be curved or angled to permit an ergonomic hold. The nozzle and/or part of the body near the outlet end (and/or outlet bore segment) may be aligned along axis 64, and the part of the body near the inlet end (and/or inlet bore segment) may be aligned along axis 62, such that line segments originating from the intersection of the two axes and extending toward the inlet end and the outlet end, respectively, define an included angle $\alpha$. In the embodiment depicted in FIG. 11, included angle $\alpha$ is 130°. In other embodiments, the included angle $\alpha$ may be in the range from 90° to 170°, 90° to 135°, 90° to 130°, no larger than 133°, and/or 110° to 130°.

In some embodiments, the lever may be positioned on a side of the body 14 opposite the included angle and operably coupled to the valve.

Figure 12:
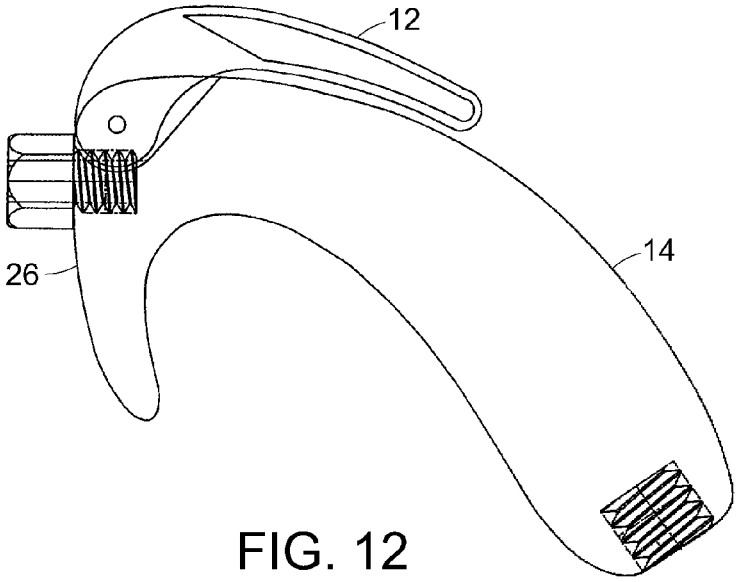
FIG. 12 shows another embodiment of a safety air gun.

As shown in FIG. 12, lever 12 may be attached to the body 14 at an attachment position that is at or adjacent the outlet end 26.

Figure 13:
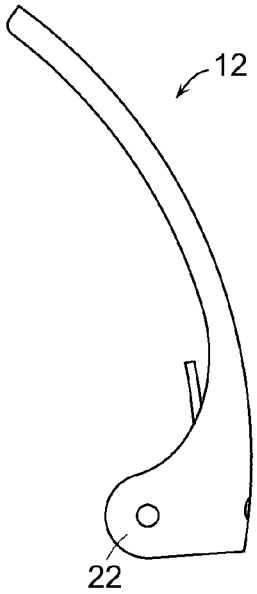
FIGS. 13-18 illustrate embodiments of levers for a safety air gun.

Levers are shown in greater detail in FIGS. 13-18. A side view of a lever 12 without an outer coating is shown in FIG. 13. The lever may have a constant radius of curvature or may be formed with a flat portion and/or multiple radii. The outer coating material may include rubber, plastic, and/or one or more polymers. The coating may be applied to lever by placing the lever core in a mold and injection-molding the cover around the core. The lever core may be composed of a wide variety of materials, such as metal, steel, and/or plastic.

Figure 14:
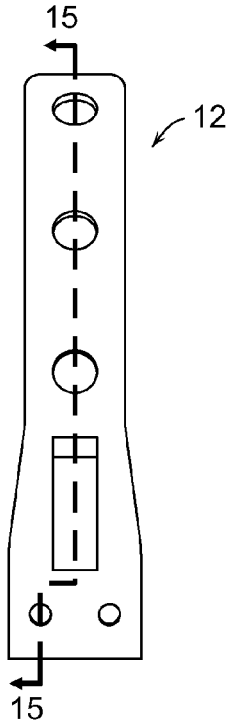

As shown in FIG. 14, the lever may be formed with one or more holes. The holes may be formed by casting, molding, drilling, etc. The holes reduce the weight of the lever and/or allow the coating material to fill in the holes during injection molding to strengthen the bond between the outer coating and the lever, preventing slippage of the outer coating from the lever. The size, shape, and positioning of the holes may differ from what is depicted in FIG. 14.

The width and/or thickness of the lever may taper from one end to the other.

Figure 15:
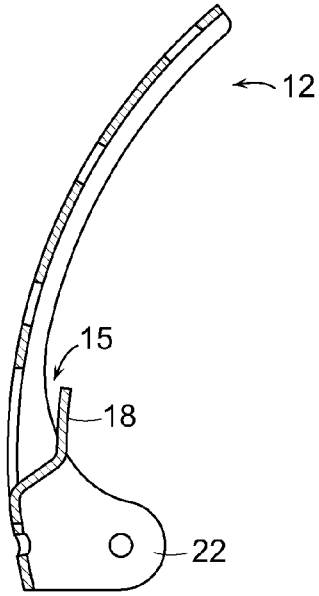

FIG. 15 shows a strike plate 18 having an L-shaped extension 15 extending from the lever 12. The strike place may be located on the concave surface of the lever 12. A portion of the strike plate 18 may be covered or excluded from the injection-molding mold during the coating process to preserve a section of metal surface to allow a metal to metal contact with the valve stem 20.

Figure 16:
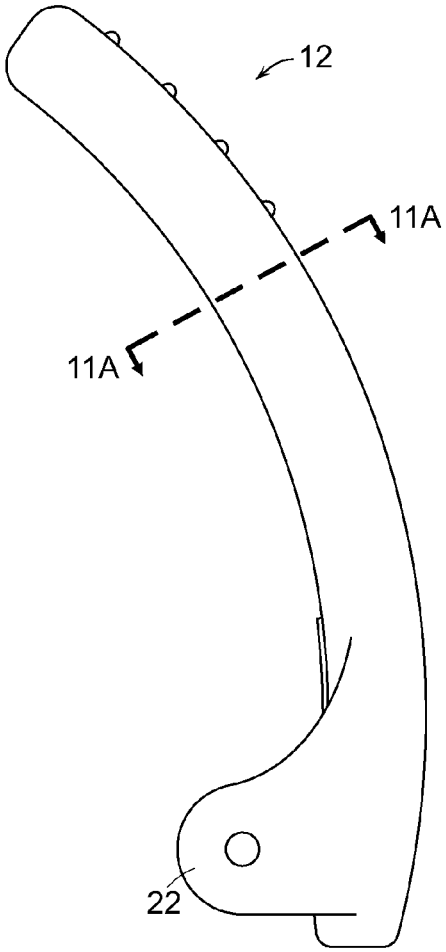
Figure 17:
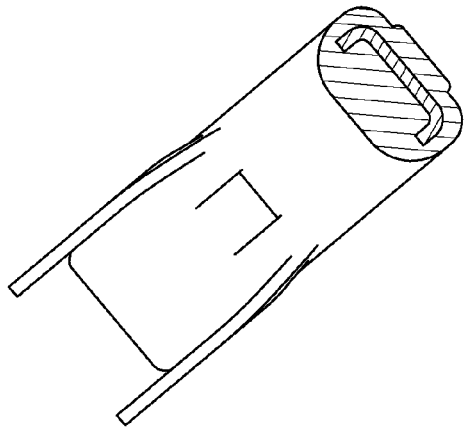
Figure 18:
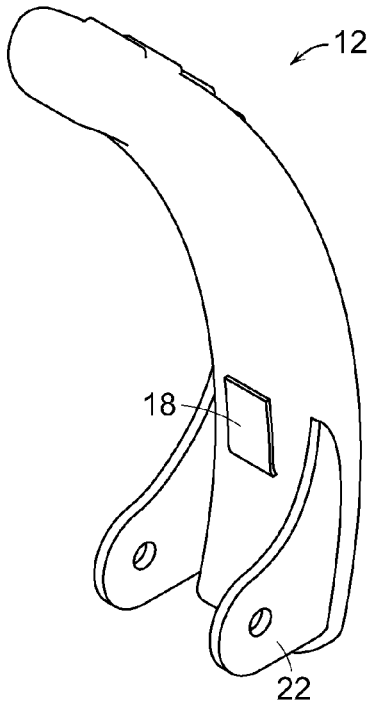

FIG. 16 shows a lever with an outer surface coating. Referring to FIG. 17, the lever may have a U-shaped cross-section to improve its strength and/or bending resistance. Other cross-sections may be used, such as I-shaped, W-shaped (corrugated), etc. The pinch guard 22 may be covered during the coating process to allow smooth interaction between a metal pinch guard 22 against a metal body 14. On the convex surface of the lever 12, a plurality of friction bumps 30 may be disposed with an equal spacing or varying spacing between the bumps to allow better grip by a user. FIG. 18 shows an isometric view of a finished lever 12 showing an exposed metal strike plate 18.

Figure 19:
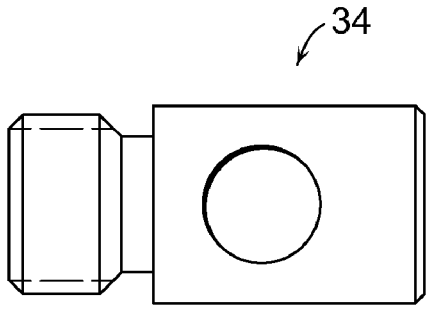
FIG. 19 illustrates a side view of a nozzle.

An exemplary embodiment of a nozzle 34 is illustrated in FIG. 19. The nozzle 34 may include a threaded portion along the length to be connected to the body 14. The nozzle may also include circular or equivalently shaped holes to let the air escape if the safety air gun 10 reaches its maximum capacity and/or to draw surrounding air into the flow. The bore of the nozzle may have a venturi (a region of decreased diameter) to increase flow velocity. A wide variety of nozzles can be used, having varying lengths and conical or frusto-conical tips.

Figure 20:
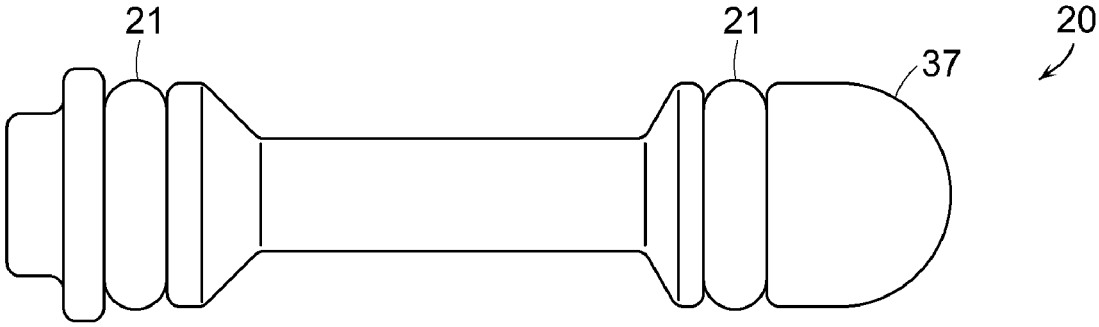
FIG. 20 shows a side view of a valve stem.

FIG. 20 shows an exemplary embodiment of a valve stem 20 with strike end 37 for contacting the strike plate. The strike end may be rounded, as shown, flat, and/or angled to receive the strike plate. O-rings 21 may be seated on the stem to help seal the valve. Edges adjacent to the O-rings 21 may be chamfered or straight instead of rounded as shown in the figure. The straight portion of the valve stem 20 may be so shaped and sized to allow a spring to be disposed for lever actuation.

Figure 21:
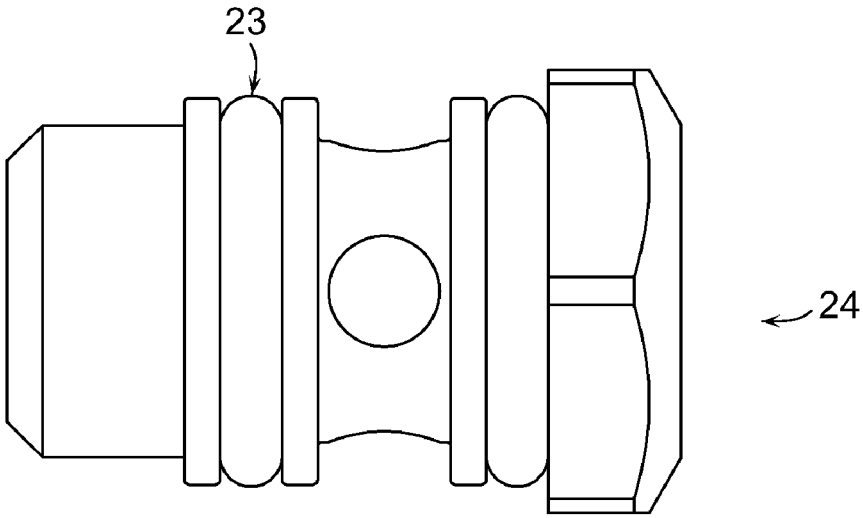
FIG. 21 illustrates a side view of a valve body.
Figure 22:
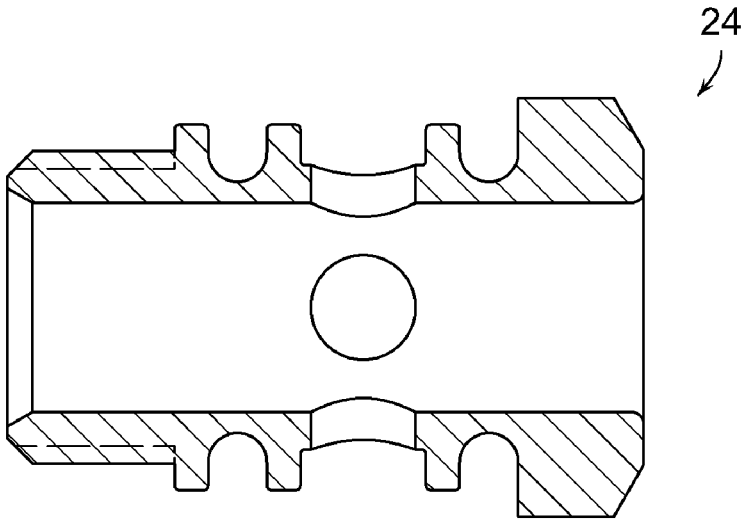
FIG. 22 illustrates a longitudinal cross-section of a valve body.

In FIG. 21, an exemplary embodiment of a valve body 24 is shown with O-rings 23 and a hexagonally shaped head. A portion of the valve body may be threaded to be screwed into the body 14. The valve body 24 may retain the valve stem 20 in such a way to allow a controlled longitudinal movement of the valve stem 20 within the valve body 24 during lever actuation. FIG. 22 is a longitudinal cross-sectional view of the valve body 24 shown in FIG. 21.

A preferred method of operating a safety air gun 10 may include grasping the safety air gun 10 in a hand so that the index finger of the hand is located in the hook region 38 and having the second, third, and fourth fingers curl around the concave side of the body 14 and the thumb resting against the lever 12. Lever 12 can be squeezed toward the convex side of the body 14 to permit flow through the body 14.

Figure 23:
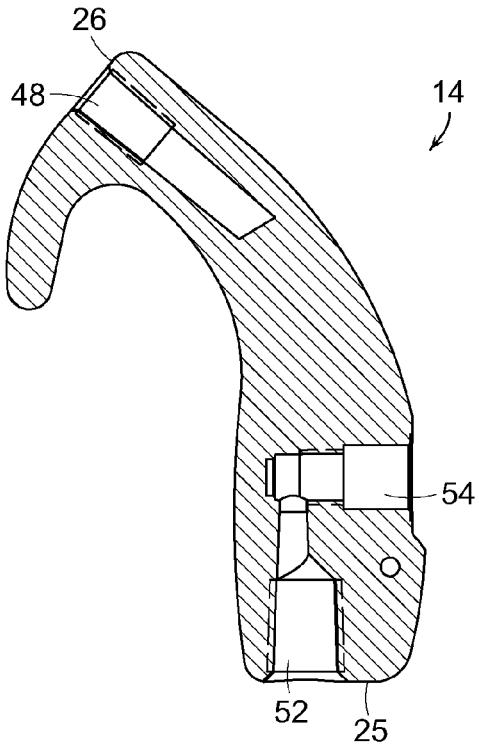
FIG. 23 shows a longitudinal cross-section of an embodiment of a body for a safety air gun after the body has been formed with an inlet bore segment, an outlet bore segment, and a valve bore segment.
Figure 24:
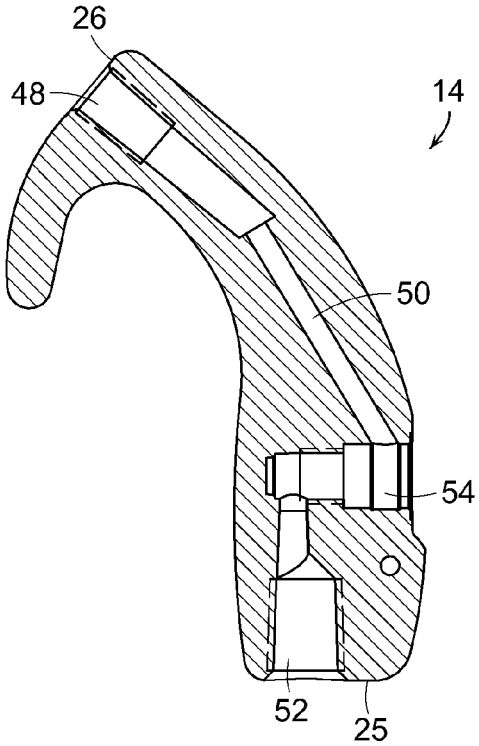
FIG. 24 depicts a longitudinal cross-section of an embodiment of a body after the intermediate bore segment has been formed and threads have been formed in the inlet bore segment, the outlet bore segment, and the valve bore segment.

The body 14 may be formed with the inlet bore segment 52, the outlet bore segment 48, and the valve bore segment 54 as shown in FIG. 23. The forming may be accomplished in a variety of ways, such as casting, molding, injection molding, forging, electrical discharge machining (EDM), and/or machining, among other methods. After the body is formed, an intermediate bore segment 50 may be formed, such as by drilling, broaching, milling, machining, and/or EDM, among other methods. In the case of drilling, the intermediate bore segment may be drilled by advancing a drill bit through the valve chamber bore 54 at an angle as shown in FIG. 24. Alternatively, intermediate bore segment may be formed at the same time as the rest of the body is formed.

At least parts of the inlet, outlet, and/or the valve bore segments may be threaded, for example by molding and/or tapping.

We claim:

1. A safety air gun comprising:

a body having a shape that curves from an inlet end to an outlet end, thereby defining a convex side and a concave side;

a bore that is defined by the body, extends between the inlet end and the outlet end, and is formed from:

an inlet bore segment extending from and opening at the inlet end;

a valve bore segment having an opening to the convex side of the body and communicating with the inlet bore segment;

an intermediate bore segment communicating with the valve bore segment and oriented at an angle such that the intermediate bore segment is accessible from the convex side through the valve bore segment opening; and an outlet bore segment communicating with the intermediate bore segment and extending from and opening at the outlet end;

a valve so disposed in the valve bore segment as to regulate flow through the bore; and a valve-operating lever positioned on the convex side of the body and operably coupled to the valve.

2. The safety air gun defined by claim 1, wherein the lever has a curved shape.

3. The safety air gun defined by claim 2, wherein the curved shape of the lever has a constant radius of curvature.

4. The safety air gun defined by claim 1, wherein the lever has a length of at least 4⅛ inches.

5. The safety air gun defined by claim 1, wherein the lever is attached to the body at, and pivots with respect to the body around, a pivot axis.

6. The safety air gun defined by claim 5, wherein the pivot axis is positioned within ¾ inch of one of the body ends.

7. The safety air gun defined by claim 5, wherein the lever is attached to the body by pinch guards.

8. The safety air gun defined by claim 1, wherein the lever comprises a rubber grip.

9. The safety air gun defined by claim 1, wherein the lever comprises a strike plate so positioned as to contact a valve stem of the valve.

10. The safety air gun defined by claim 9, wherein the strike plate comprises a tongue extending from the lever.

11. The safety air gun defined by claim 1, further comprising a protuberance extending from the concave side at the outlet end, thereby defining a hook with the concave side.

12. The safety air gun defined by claim 11, wherein a length of the concave side extending from (a) a point defined by a line tangent to the hook and a line perpendicular to the convex surface, to (b) the inlet end is at least 4 inches.

13. The safety air gun defined by claim 11, wherein the lever has a length that is at least as long as the length of the concave side.

14. A method of operating a safety air gun defined by claim 11, comprising:

grasping the safety air gun in a hand so that the index finger of the hand is located in the hook, the second, third, and fourth fingers of the hand curl around the concave side of the body, and the thumb rests against the lever; and squeezing the lever toward the convex side of the body, thereby operating the valve to permit flow through the body.

15. The safety air gun defined by claim 1, wherein the inlet end is oriented along an inlet axis, the outlet end is oriented along an outlet axis, and the inlet axis and the outlet axis define an included angle no larger than 133 degrees.

16. The safety air gun defined by claim 15, wherein the included angle is no larger than 130 degrees.

17. The safety air gun defined by claim 16, wherein the included angle is at least 90 degrees.

18. The safety air gun defined by claim 1, wherein the body bulges in a portion adjacent the inlet end.

19. The safety air gun defined by claim 1, further comprising a nozzle attached to the outlet end of the body.

20. A safety air gun comprising:

a body having an inlet end oriented along an inlet axis and an outlet end oriented along an outlet axis, the inlet axis and the outlet axis defining an included angle no larger than 133 degrees;

a bore that is defined by the body, extends between the inlet end and the outlet end, and is formed from:

an inlet bore segment extending from and opening at the inlet end;

a valve bore segment having an opening to a side of the body opposite the included angle and communicating with the inlet bore segment;

an intermediate bore segment communicating with the valve bore segment and oriented at an angle such that the intermediate bore segment is accessible from the side of the body opposite the included angle through the valve bore segment opening; and an outlet bore segment communicating with the intermediate bore segment and extending from and opening at the outlet end;

a valve so disposed in the valve bore segment as to regulate flow through the bore; and a valve-operating lever positioned on the side of the body opposite the included angle and operably coupled to the valve.

21. A safety air gun comprising:

a body having an inlet end and an outlet end and defining a bore that extends between the inlet end and the outlet end, the bore formed from:

an inlet bore segment extending from and opening at the inlet end;

a valve bore segment having an opening to an outside surface of the body and communicating with the inlet bore segment;

an intermediate bore segment communicating with the valve bore segment and oriented at an angle such that the intermediate bore segment is accessible from the outside surface of the body through the valve bore segment opening; and an outlet bore segment communicating with the intermediate bore segment and extending from and opening at the outlet end;

a valve so disposed in the valve bore segment as to regulate flow through the bore; and a valve-operating lever that:

has a first end and a second end;

is attached to the body at an attachment position that is at or adjacent one of the first and second ends;

curves with a constant radius of curvature between the attachment position and the more distant of the first and second ends; and is operably coupled to the valve.

22. A safety air gun comprising:

a body having an inlet end and an outlet end and defining a bore that extends between the inlet end and the outlet end, the bore formed from:

an inlet bore segment extending from and opening at the inlet end;

a valve bore segment communicating with the inlet bore segment and opening to a surface of the body;

an intermediate bore segment communicating with the valve bore segment and oriented at an angle such that the intermediate bore segment is accessible from the outside surface of the body through the valve bore segment opening; and an outlet bore segment communicating with the intermediate bore segment and extending from and opening at the outlet end;

a valve so disposed in the valve bore segment as to regulate flow through the bore; and a valve-operating lever attached to the body and operably coupled to the valve.

23. A method of manufacturing a safety air gun defined by claim 22, comprising:

forming the body with the inlet bore segment, the outlet bore segment, and the valve bore segment;

forming the intermediate bore segment by advancing a drill bit through the valve bore segment at an angle;

forming threads in at least part of the inlet bore segment;

attaching a nozzle to the outlet bore segment;

inserting the valve into the valve bore segment; and attaching the lever to the body so that it is operably coupled to the valve.

* * * * *

UNITED STATES PATENT AND TRADEMARK OFFICE

CERTIFICATE OF CORRECTION

PATENT NO. : 7,591,435 B1
APPLICATION NO. : 11/669125
DATED : September 22, 2009
INVENTOR(S) : William T. Downey et al.

It is certified that error appears in the above-identified patent and that said Letters Patent is hereby corrected as shown below:

Col. 4, line 29: insert --110° to 135°,-- before "and/or".

Col. 8, line 18 (Claim 22): replace "a surface of the body" with --an outer surface of the body--.

Signed and Sealed this

Twenty-seventh Day of October, 2009

David J. Kappos

David J. Kappos
*Director of the United States Patent and Trademark Office*